United States Patent [19]

Edwards

[11] Patent Number: 4,543,061

[45] Date of Patent: Sep. 24, 1985

[54] AIR COOLED ROTARY KILN FEED END DAM

[75] Inventor: Don L. Edwards, Ponca City, Okla.

[73] Assignee: Conoco Inc., Ponca City, Okla.

[21] Appl. No.: 595,900

[22] Filed: Apr. 2, 1984

[51] Int. Cl.[4] ..... F27B 7/24; F27B 7/38; F27B 7/28

[52] U.S. Cl. ..... 432/115; 432/116; 432/119

[58] Field of Search ..... 432/115, 116, 119, 233

[56] References Cited

U.S. PATENT DOCUMENTS

| | | | |
|---|---|---|---|
| 628,940 | 7/1899 | Hurry et al. | 432/115 |
| 1,620,989 | 3/1927 | Agthe | 432/115 |
| 2,266,396 | 12/1941 | Lincoln et al. | 432/115 |
| 2,826,403 | 3/1958 | Moklebust | 432/115 |
| 3,016,236 | 1/1962 | Alonso | 432/115 |
| 3,532,330 | 10/1970 | Swanson | 432/115 |
| 3,751,199 | 8/1973 | Toft | 432/115 |
| 3,806,311 | 4/1974 | Barber | 432/115 |
| 3,940,239 | 2/1976 | Rossi et al. | 432/115 |

FOREIGN PATENT DOCUMENTS

| | | | |
|---|---|---|---|
| 938839 | 2/1956 | Fed. Rep. of Germany | 432/116 |

*Primary Examiner*—John J. Camby

*Attorney, Agent, or Firm*—Richard W. Collins

[57] ABSTRACT

The feed end dam of a rotary kiln is cooled by air directed into an annulus between the feed end dam and a seal mechanism.

2 Claims, 4 Drawing Figures

AIR COOLED ROTARY KILN FEED END DAM

BACKGROUND OF THE INVENTION

1. Field of the Invention

This invention relates to generally horizontal inclined rotary kilns of the type used to calcine various industrial products such as cement and petroleum coke. The term "rotary kiln" as used herein is intended to include generally horizontal inclined rotary devices having a feed end and a discharge end and in which the feed end is subjected to high temperatures, such as internally fired calcining kilns, rotary coolers for cooling hot particulate matter, roasting furnaces, reduction furnaces or the like.

More particularly, this invention relates to an improved means for cooling the feed end dam of a rotary kiln.

2. The Prior Art

Numerous techniques have been employed to protect rotary kiln internals from the effects of the high temperatures to which they are exposed. Essentially the entire inner surface of a typical rotary kiln is lined with refractory insulating material. In some cases this is the only protection provided. In other cases, special cooling means such as circulating liquids or jets of cooling gases have been employed to protect the discharge ends of rotary kilns.

U.S. Pat. No. 2,826,403 describes a cooling arrangement in which a cooling medium such as water is used to cool the discharge end of a rotary kiln.

U.S. Pat. No. 3,940,239 describes a cooling arrangement in which air is directed into an annulus about the discharge end of a rotary kiln.

U.S. Pat. Nos. 1,620,989 and 3,806,311 disclose use of liquid cooling at the discharge end of a rotating furnace.

Prior to this invention, the feed end dams of rotary kilns have been protected by refractory insulation.

SUMMARY OF THE INVENTION

According to the present invention, the feed end dam of a rotary kiln is protected by injection of cooling fluid, preferably air, into an annulus formed between the feed end dam and a sealing mechanism. The cooling fluid preferably is injected through a series of nozzles spaced about the circumference of the feed end of the kiln.

It is an object of the invention to provide improved cooling means for the feed end dam portion of a rotary kiln.

THE DRAWINGS

DESCRIPTION OF THE PREFERRED EMBODIMENT

Figure 1:
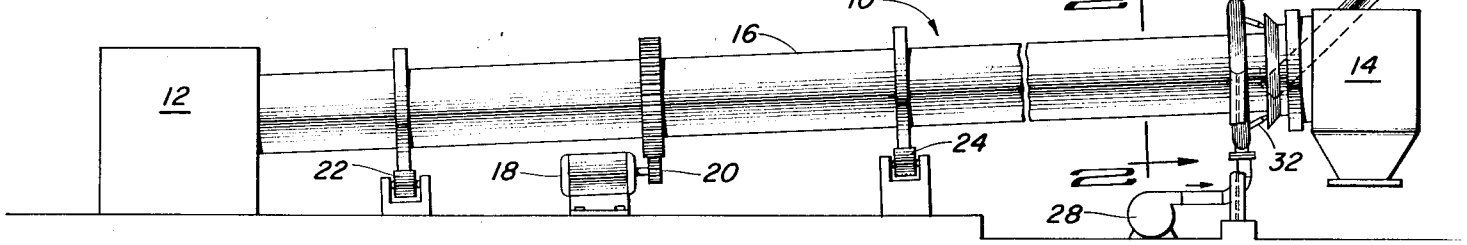
FIG. 1 is a side elevation showing a rotary kiln with feed end cooling means in accordance with the invention.

Referring to FIG. 1, a rotary kiln 10 having a discharge end housing 12 and a feed end housing 14 is shown. Rotation of the elongated tubular portion 16 of kiln 10 is effected by motor 18 and gears 20. Support bearings 22, 24, are provided along the length of tubular portion 16. A feed spout 26, to be described in more detail below, extends through feed end housing 14 for feeding material to be calcined into the kiln. Also shown in FIG. 1 is an air blower 28 which blows air into air distribution ring 30 and out nozzles 32 to cool the feed end dam 34 (FIG. 3) which is of reduced diameter relative to tubular portion 16 and which extends into feed end housing 14.

Figure 4:
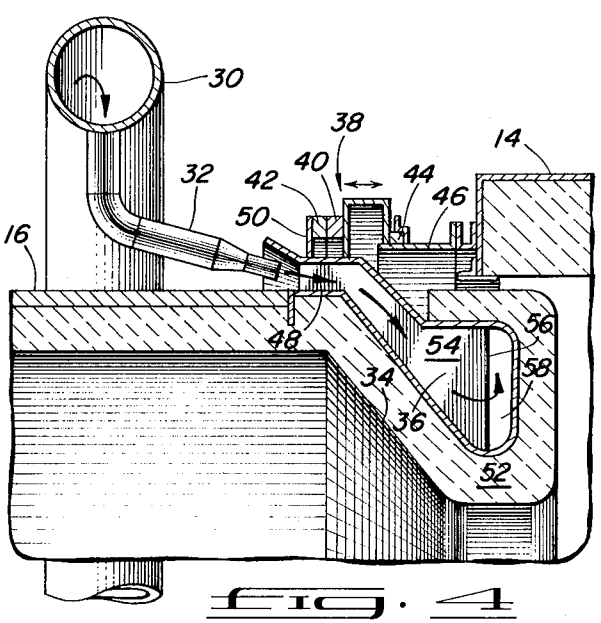
FIG. 4 is an enlarged view of the upper portion of FIG. 3.
Figure 3:
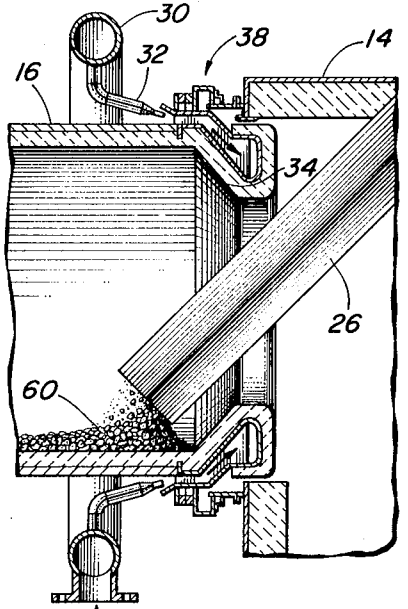
FIG. 3 is a side elevation, partially cut away, showing the overall feed end cooling means in accordance with the invention.
Figure 2:
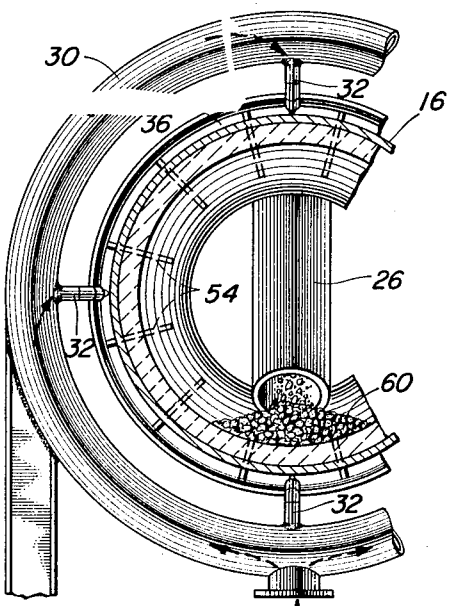
FIG. 2 is a partial cross-sectional view taken along the line 2—2 of FIG. 1.

Referring now to FIGS. 2, 3, and 4, air distribution ring 30 surrounds kiln 10 near the feed end thereof, and nozzles 32 direct air into an annulus 36 formed between feed end dam 34 and sealing mechanism 38.

Sealing mechanism 38 is similar in many respects to the sealing mechanism described in detail in the aforementioned U.S. Pat. No. 3,940,239. The sealing mechanism is designed to eliminate or at least minimize gas flow into or out of the kiln, and includes stationary ring 40 which abuts rotating ring 42 which rotates with kiln 10. A sliding seal ring 44 does not rotate, but slides along cylindrical extension 46 of feed end housing 14 to accommodate expansion of kiln 10 as it is heated.

Annulus 36 is formed by an extension 48 of tubular portion 16 conforming to the shape of feed end dam 34 and then extending back over the feed end dam as shown best in FIG. 4. Ring support 50 attached to extension 48 is provided for supporting rotating seal ring 42. Tubular portion 16, feed end dam 34, the part of extension 48 subjected to the highest temperatures, and feed end housing 14 are all provided with refractory insulation 52. A series of support baffles 54 (FIGS. 2 and 4) are provided in extension 48. Baffles 54 terminate short of the end of annulus 36 at edge 56 (FIG. 4) to form interior air passages 58 between adjacent baffles. Cooling air from air distribution ring 30 passes through nozzles 32 into annulus 36 between two of the baffles 54, then through the interior air passages 58 and out adjacent portions of annulus 36. With four nozzles 32 and twelve baffles 54, it can be seen (FIG. 2) that the entire circumference of feed end dam 34 can be continuously subjected to cooling air flow.

OPERATION

The operation of kiln 10 is generally the same whether it is used as a calciner, a furnace, or a cooler. Particulate material 60 to be heated or cooled is introduced into kiln 10 through feed spout 26 inside feed end dam 34. Feed end dam 34 is shaped to prevent particulate material 60 from backing into feed end housing 14. Particulate material 60 moves through kiln 10 toward discharge end housing 12 due to rotation and inclination of tubular portion 16. In the embodiment where kiln 10 is an internally fired calciner, very hot gases pass over feed end dam 34 toward feed end housing 14. Prior art kilns have relied on insulation to protect feed end dams. However, insulation alone is often insufficient to effectively protect the feed end dam, and insulation failure and metal failure in this area have often resulted in the need for frequent repairs. Even though the discharge ends of prior art kilns have been air-cooled, prior to this invention no effective manner of air cooling the feed end dams of rotary kilns has been available, probably because the shape of the feed end dam was felt to preclude effective air cooling.

Air from blower 28 passes through distribution ring 30 and then is directed through nozzles 32 into annulus 36. When in the position shown in FIG. 2, it will be seen that the entire circumference of feed end dam 34 is subjected to flow of cooling air because of the openings 58 (FIG. 4) between adjacent baffles. As the tubular portion 16 of kiln 10 rotates, air is injected sequentially into spaces between baffles and passes out through spaces on either side of these spaces, with the result that the entire circumference of the feed end dam is continuously subjected to flow of cooling air.

The foregoing description of the construction and operation of the preferred embodiment of the invention is intended to be illustrative rather than limiting. Modifications and variations within the scope of the invention will be apparent to those skilled in the art, and are intended to be included by the appended claims.

I claim:

1. In a rotary kiln comprised of a refractory lined inclined generally horizontal rotating cylinder having a discharge end and a feed end, wherein said feed end includes a refractory lined dam section of reduced diameter which extends into a stationary feed end housing and which prevents material fed to said feed end from backing up into said feed end housing, wherein a sealing mechanism is provided between said feed end dam section and said feed end housing, and wherein said feed end includes an annulus between said dam section and said sealing mechanism, the improvement wherein:

(a) said feed end section comprises an extension member extending from said rotating cylinder first forming said dam section and then extending back over the outside of said dam section to form said annulus, said dam section and at least a part of said extension member extending back over said dam section forming said annulus being refractory lined;

(b) cooling means comprising forced air means, an air distribution ring and a plurality of nozzles directed into said annulus are provided;

(c) a plurality of support baffles within said annulus are provided, said support baffles extending inwardly from the outer portion of said annulus; and (d) flow passage means at the inner portion of said baffles are provided.

2. The rotary kiln of claim 1 wherein said nozzles and said support baffles are arranged to continuously provide flow of cooling air over the entire circumference of said feed end dam.

* * * * *